US010469964B2

(12) United States Patent
Sø et al.

(10) Patent No.: US 10,469,964 B2
(45) **Date of Patent: *Nov. 5, 2019**

(54) HEARING DEVICE

(71) Applicant: Oticon A/S, Smørum (DK)

(72) Inventors: Rune Sø, Smørum (DK); Jens Troelsen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/906,531

(22) Filed: Feb. 27, 2018

(65) Prior Publication Data

US 2018/0192213 A1 Jul. 5, 2018

Related U.S. Application Data

(62) Division of application No. 15/277,183, filed on Sep. 27, 2016, now Pat. No. 9,967,686.

(30) Foreign Application Priority Data

Sep. 28, 2015 (EP) ..... 15187123

(51) Int. Cl.
*H04R 25/00* (2006.01)

(52) U.S. Cl.
CPC ..... *H04R 25/65* (2013.01); *H04R 25/554* (2013.01); *H04R 25/60* (2013.01); *H04R 25/552* (2013.01); *H04R 2225/49* (2013.01); *H04R 2225/51* (2013.01)

(58) Field of Classification Search
CPC ..... H04R 2225/51
See application file for complete search history.

(56) References Cited

U.S. PATENT DOCUMENTS 7,742,614 B2 * 6/2010 Christensen ..... H01Q 1/273 320/108
9,635,475 B2 * 4/2017 Polinske ..... H01Q 7/00
9,722,306 B2 * 8/2017 So ..... H01Q 1/273
(Continued)

FOREIGN PATENT DOCUMENTS

EP 1 465 457 A2 10/2004
EP 1 653 560 A1 5/2006
(Continued)

*Primary Examiner* — Curtis A Kuntz
*Assistant Examiner* — Ryan Robinson
(74) *Attorney, Agent, or Firm* — Birch, Stewart, Kolasch & Birch, LLP

(57) ABSTRACT

A hearing device configured to be worn at an ear of a user, where the hearing device comprising an antenna unit. The antenna unit comprises an active unit being connected to a ground unit by a feeder unit, the active unit includes an active surface, and a shield unit having a continuous surface, where a first section of the continuous surface may be arranged adjacent to the active surface. Furthermore, the active surface may be configured to transmit an electric field in a direction along or perpendicular to an ear-to-ear axis of the user when the hearing device may be worn in its operational position by the user, whereby the electric field may be coupled by a capacitive coupling towards the first section generating an electromagnetic near field, and where the shield unit may be configured to focus the electromagnetic near field inside the hearing device.

19 Claims, 6 Drawing Sheets

(56) References Cited

U.S. PATENT DOCUMENTS

| | | | | |
|---|---|---|---|---|
| 9,729,979 | B2 * | 8/2017 | Ozden | H01Q 1/273 |
| 2004/0196996 | A1 * | 10/2004 | Feitel | H04R 25/65 381/322 |
| 2005/0099341 | A1 * | 5/2005 | Zhang | H01Q 1/273 343/700 MS |
| 2009/0231204 | A1 * | 9/2009 | Shaker | H01Q 1/273 343/700 MS |
| 2009/0274328 | A1 * | 11/2009 | Gebhardt | H04R 25/554 381/331 |
| 2013/0343586 | A1 * | 12/2013 | Kvist | H04R 25/554 381/315 |
| 2016/0183015 | A1 * | 6/2016 | So | H04R 25/60 381/315 |
| 2016/0381471 | A1 * | 12/2016 | Henriksen | H04R 25/554 381/315 |

FOREIGN PATENT DOCUMENTS

| | | | |
|---|---|---|---|
| EP | 2 680 366 | A1 | 1/2014 |
| EP | 2 985 834 | A1 | 2/2016 |

* cited by examiner

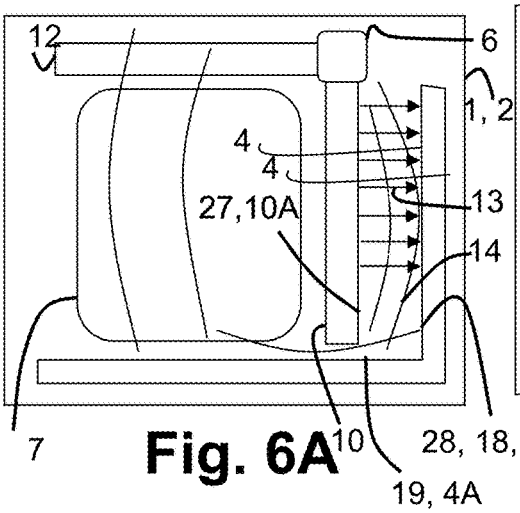
Fig. 6A
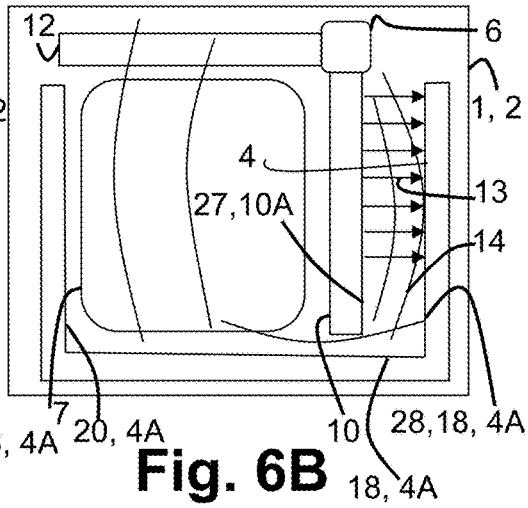
Fig. 6B
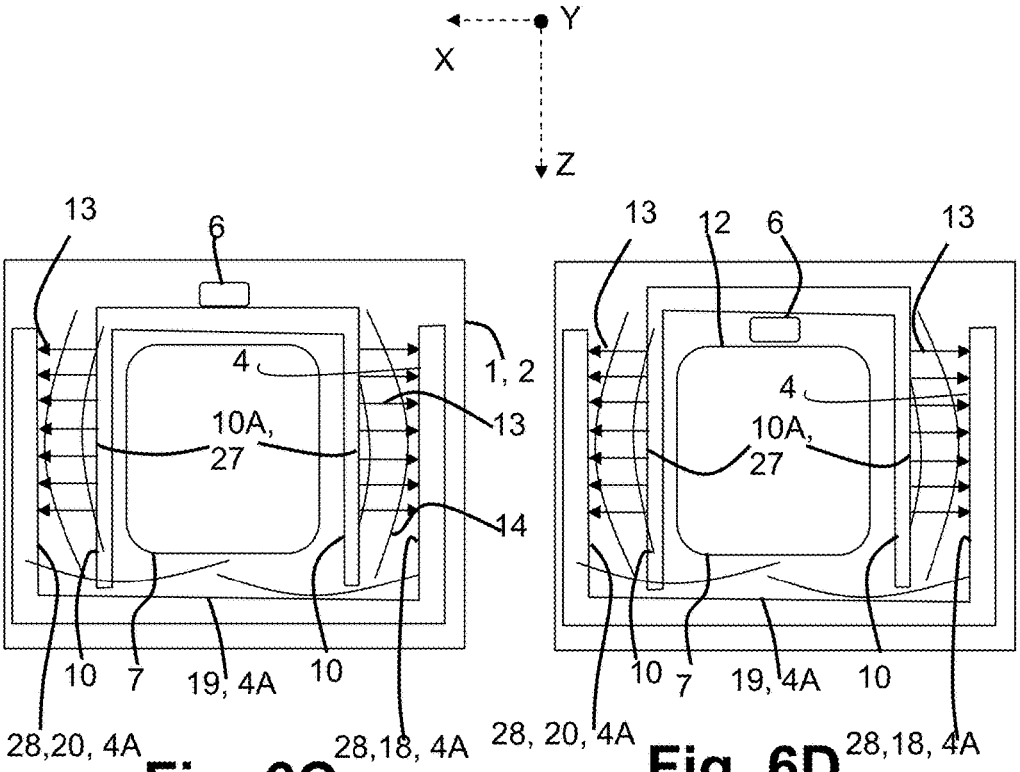
Fig. 6C
Fig. 6D

HEARING DEVICE

CROSS-REFERENCE TO RELATED APPLICATIONS

This application is a Divisional of co-pending application Ser. No. 15/277,183, filed on Sep. 27, 2016, which claims priority under 35 U.S.C. § 119(a) to application Ser. No. 15/187,123.3, filed in Europe on Sep. 28, 2015, all of which are hereby expressly incorporated by reference into the present application.

TECHNICAL FIELD

The disclosure relates to a hearing device that is adapted for wireless communication with one or more external devices.

BACKGROUND

Hearing devices are very small and delicate devices and comprise many electronic and metallic components contained in a housing small enough to be located behind the outer ear. The many electronic and metallic components in combination with the small size of the hearing device housing impose high design constraints on radio frequency antennas to be used in hearing devices with wireless communication capabilities.

The provision of sufficient bandwidth and reasonable efficiency of an antenna unit in a portable communication device is a general problem. It is known that wireless solutions, e.g. operating at an operational frequency of 2.4 GHz, found in current hearing devices and hearing aid devices suffer from high radiation efficiency loss, when the hearing aid is placed behind the ear. The loss is mainly due to absorption in the head of the user wearing the hearing device.

One problem is the radiation efficiency loss, which degrades communication range and increase power consumption if the communication bandwidth is to be maintained.

Therefore, there is a need to provide a solution that addresses at least some of the above-mentioned problems, or at least provide an alternative to the prior art.

SUMMARY

The disclosure provides an antenna unit suitable for wireless communication in a portable communication device, in particular an antenna unit for a hearing device.

An embodiment of the present disclosure is achieved by a hearing device configured to be worn at an ear of a user, where the hearing device comprising an antenna unit. The antenna unit may comprise an active unit being connected to a ground unit via a feeder unit. The active unit may include an active surface. The antenna unit may include a shield unit having a continuous surface, where a first section of the continuous surface may be arranged adjacent to the active surface. Furthermore, the active surface may be configured to transmit an electric field in a direction along or perpendicular to an ear-to-ear axis of the user when the hearing device may be worn in its operational position by the user, whereby the electric field may be coupled by a capacitive coupling towards the first section generating an electromagnetic near field. The shield unit may be configured to focus the electromagnetic near field inside the hearing device.

The hearing device may comprise an antenna unit where the active unit of the antenna unit is capacitive coupled to the shield unit, whereby the radiation efficiency of the antenna unit is improved, and thereby, allowing higher data rate, longer communication range and/or lower power consumption.

The hearing device may comprise an antenna unit with capacitive coupling to the shield unit, because a left/right performance stability is improved, i.e. the antenna efficiency is less affected by whether the hearing device is placed on the left or right ear. This is advantageous in that it eliminates a need to manufacture a specific device adapted to be placed at a specific left or right ear.

The hearing device may be a hearing aid that is adapted to improve or augment the hearing capability of a user by receiving an acoustic signal from a user's surroundings, generating a corresponding audio signal, possibly modifying the audio signal, e.g. by selectively amplifying one or more frequency regions in the audio signal, compress or transpose the audio signal or any other type of audio processing, and providing the possibly modified audio signal as an audible signal to at least one of the user's ears. The hearing aid may thus compensate for a user's specific hearing loss. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device may be a Behind-The-Ear hearing device or a Receiver-In-The-Ear hearing device. Both types of devices have a housing that is configured to be worn behind the ear and a part to be located partly or fully in the ear canal.

The ear-to-ear axis extends between left ear and right ear of a user.

The hearing device may comprise a housing which may be a structural part of the hearing device enclosing and/or supporting some, such as a majority or all of the components of the hearing device, including electronic components of the hearing device. The housing may constitute the outer spatial confinement of the device. The housing may be at least partly impervious to moisture and/or water.

The housing may have two side surfaces along the ear-to-ear axis, two end surfaces along an end-to-end axis orthogonal to the ear-to-ear axis when the hearing device is positioned at the ear of the user, and an upper side surface and a lower side surface along an upper-to-lower axis orthogonal to the ear-to-ear axis and the end-to-end axis.

The active unit of the antenna unit may have a radiation characteristic as a monopole antenna. During transmission, the active unit of the antenna unit is supplied with a current signal from the feeder unit and emitting an electric field. The active unit may have an active surface, where a longitudinal direction of the active surface may be located either parallel+/−10% or orthogonal+/−10% to the ear-to-ear axis of the user, when the hearing device is worn in its operational position by the user.

The active unit may be formed in a material such as aluminum, cobber, or any conductive metal.

The active unit may have any shape suitable for the hearing device. For example, the active unit may be formed as a metal plate or as a metal wire, where a longitudinal direction of the shield unit is at least orthogonal to the ear-to-ear axis when the hearing device is worn at the user's ear, i.e. the metal plate may be located in the housing such that the longitudinal direction of the metal plate is at least parallel to the upper-to-lower axis or to the end-to-end axis of the housing.

The ground unit of the antenna unit may be connected to the active unit via the feeder unit. In the hearing device, the ground unit may be a battery, a receiver, a printed circuit board or any other suitable component or combination of components within the hearing device which has a conductive surface acting as a return path for current from different components within the housing.

Parts of a printed circuit board may be, at least part of, the ground unit.

The shield unit may have a continuous surface, where the first section of the continuous surface may be arranged adjacent to the active surface. The distance between the first section and the active surface may be in the range of about 30 μm to 5 mm, 0.1 mm to 0.5 mm, 0.1 mm to 1 mm, 0.35 mm to 1.25 mm, or 0.25 mm to 5 mm.

The electric field generated by the active unit may be coupled by a capacitive coupling towards the first section of the continuous surface. The capacitive coupling between the continuous surface and the active surface generates an electromagnetic near field which then generates a current in the shield unit. The shield unit in capacitive coupling with the active unit generates a shielding effect which focus the electromagnetic near field. By focusing some or majority of the electromagnetic near field it is meant that the direction of the radiation of the electromagnetic near field is shaped and directed in certain directions, e.g. away from the head of the user wearing the hearing device.

Hence, the antenna unit becomes more efficient due to the focusing of the electromagnetic near field.

The shield unit may have a longitudinal length in a longitudinal direction and a transverse length in a transverse direction. By increasing the longitudinal length and/or the transverse length, i.e. increasing the area of the shield unit, the shielding effect improves causing an improved focusing of the electromagnetic near field which results in an improved antenna efficiency.

The shield unit may have any shape which fits into a housing of the hearing device and which may prevent or limit the generated electromagnetic near field from radiating into a head of a user. The shield unit may be arranged within the housing of the hearing device and between other components within the hearing device.

The shield unit may have a continuous surface having one or more sections formed in one single element, i.e. the continuous surface may be a single unit and not a combination of multiple units coupled together.

The shield unit may have multiple sections, where a first section is arranged with a second section with an angle in an inner space, and wherein the angle is between 25 deg. and 160 deg., or between 0.1 deg. and 180 deg.

The shield unit may have multiple sections, where the second section is arranged with a third section with an angle in an inner space, and wherein the angle is between 25 deg. and 160 deg., or between 0.1 deg. and 180 deg.

The effect of having multiple sections with the angle in the range between 0.1 deg. and 180 deg. is that the shield is able to be shaped in a preferred way, e.g. a bended or a curved shaped structure, such that an optimal shielding of the active unit will be obtained.

The shield unit may have at least one opening orthogonal to the ear-to-ear axis where the electromagnetic near field, generated by the antenna unit, emits through.

The hearing device may be a hearing aid or a hearing aid device.

The energy transferred from the active surface towards the continuous surface may be directed along or perpendicular to the ear-to-ear axis.

The shield unit may have a generally 'U'-shaped geometry including a first section, a second section and a third section. During transmission, the first section of the continuous surface is configured to be capacitive coupled to the active surface of the antenna unit, and the second section is part of the continuous surface and an extension to the first section. The third section is part of the continuous surface and an extension of the second section. The space between the sections defines an inner space, where at least one angle, between two adjacent sections, is between 25 deg. and 160 deg., or between 0.1 deg. and 179 deg.

The inner space may comprise one or more components which are part of the hearing device, e.g. a battery and/or a receiver and/or electronic components such as one or more processors or the like. The component(s) may help prevent an internal capacitive coupling between the different sections of the shield unit.

During transmission, the second section and/or the third section may be configured to be capacitive coupled to the active surface of the active unit. The shield unit may have one or more sections which are configured to be capacitive coupled to the antenna unit.

One or more surfaces of the housing may be made of a metallic material, where the shield unit is then the housing itself. The housing may comprise at least one surface which is made of a material, e.g. a non-metallic material, where the electromagnetic near field energy, generated by the antenna unit, is emitted through to the outside of the housing.

A housing made of a non-metallic material, one or more inner surfaces of the housing may be coated with a metallic material acting as a shield unit. At least one inner surface may not be coated with a metallic material in order for the electromagnetic near field energy to radiate through the housing to the outside of the housing. Outer surfaces of the housing may be coated with a non-metallic coating.

A housing made of a non-metallic material, one or more outer surfaces of the housing may be coated with a metallic material acting as a shield unit. At least one outer surface may not be coated with a metallic material in order for the antenna to radiate the electromagnetic near field energy outside the housing. The inner surfaces may be coated with a non-metallic coating.

In the present context, wearing the hearing device in its operational position by the user means that the hearing device is worn on the ear of the user and behind the pinna of the ear.

The active unit may be connected to a feeder unit where the active surface of the antenna unit is configured to transmit an electric field in a direction along or perpendicular to an ear-to-ear axis of a user, when the hearing device is worn in its operational position by the user. The electric field may then be coupled by a capacitive coupling towards a section, of the shield unit, generating an electromagnetic near field.

The capacitive coupling may be configured to transfer energy within an electrical network by means of the capacitance between electric conductive units, such as the active unit and the shield unit.

The shield unit may be configured to focus some of the electromagnetic near field inside the hearing device, i.e. some of or majority of the radiation pattern of the electromagnetic near field energy may be shaped or focused by the shield unit so that some of the radiation of the electromagnetic near field may radiate in a preferred direction. The preferred direction may be generally away from an absorptive medium, such as the head of a user of the hearing device. By directing the radiation of the electromagnetic near field away from absorptive medium, such as a head of a user, improves the radiation efficiency of the antenna unit and/or the sensitivity and/or the range.

Furthermore, the improved radiation efficiency of the antenna unit allows higher data rates, longer communication range and lower power consumption.

The antenna unit may comprise an active unit attached or coated on a first substrate surface of a substrate, a shield unit attached or coated on a second substrate surface of the substrate and a ground unit connected to the active unit via a feeder unit. The first substrate surface and the second substrate surface may be parallel or parallel+/−10% and positioned on the same axis, e.g. on the ear-to-ear axis, on the end-to-end axis or on the upper-to-lower axis.

The substrate having the active unit coated or attached to the first substrate surface may be attached or mounted on the housing via the second substrate surface of the substrate.

The substrate may be a flexible printed circuit board substrate, such as a flexible material where the electric field, generated by the active unit, may be coupled through the substrate and towards the shield unit attached to the second substrate surface.

One advantage of the substrate is that the production stability of the antenna unit or the hearing device, comprising the antenna unit, would be improved since the coupling distance between the active unit and the shield unit is easier to control.

The shield unit may comprise a second section arranged with the first section with a first inner angle in an inner space, and wherein the first inner angle is between 25 deg. and 160 deg, where the inner space, formed between the first section and the second section, comprises the capacitive coupling.

The continuous surface may extend along a longitudinal axis forming a third section in the extension of the second section, where the inner space is between the first section, the second section and the third section.

In the longitudinal axis of a section the length of the section is longer than the length in the transversal axis of the section, thereby, the longitudinal axis of the section is the long axis of the section, and the transversal axis of the section is the short axis of the section.

The second section and the third section may be arranged with a second inner angle in the inner space, and wherein the second inner angle is between 25 deg. and 160 deg.

A first plane of the active surface and a second plane of the first section may be parallel or parallel within +/−10 degrees. Between the first plane and the second plane the capacitive coupling is generated meaning that the first plane and the second plane are fronting each other.

In order to obtain a capacitive coupling between the active surface and the first section (or a section), the first plane and the second plane are not necessarily parallel. The two planes may be arranged in relation to each other so that the coupling efficiency of the capacitive coupling would be sufficient to obtain a shielding effect that provides an antenna efficiency that is suitable for a specific embodiment.

A housing of the hearing device may comprise at least an element, such as a battery or a receiver, positioned in the inner space between the multiple sections, i.e. between first section, second section or third section The active unit may be positioned closer to the centre of a housing of the hearing device than the shield unit. Since the purpose of the shield unit is to shield the electromagnetic near field energy from an absorptive medium, e.g. a head of a user, the shield unit would always be located such that the active surface would be screened from the absorptive medium.

The centre of the housing is defined as being the half width of the housing in the ear-to-ear axis.

A user wearing the hearing device, the hearing device is exposed to absorptive medium, such as the head of the user. The hearing device is located on the ear between the pinna of the ear and the cranial part of the head of the user. The cranial part of the head is the part of the head without the ears. It is known that the absorbance of the cranial part is much larger than the ears, and thereby, it would be essential that at least the first section is always screening and reflecting the electromagnetic near field, generated by the antenna unit, away from the cranial part. If so, the user will experience an even more improved left-right stability, since the user will experience a reduced performance difference when wearing the hearing device either on the left or the right ear.

Additionally, if the shield unit has multiple sections the screening of the electromagnetic near field, away from the head of the user, including both the ear and the cranial part, would be improved even more leading to an even more improved left-right stability.

The antenna unit may be adapted to have an operational frequency in the range from 300 MHz to 6 GHz, 500 MHz to 1 GHz, around 865 MHz or around 2.441 GHz.

The shield unit may be the housing, and the housing may comprise at least one non-metallic surface where the generated electromagnetic near field energy may radiate through.

The material of the shield unit may be a metal, such as aluminum, cobber, or any conductive metal.

The longitudinal axis in the first section may be perpendicular or perpendicular+/−10% to the ear-to-ear axis of the user, the longitudinal axis in the second section is parallel or parallel+/−10% to the ear-to-ear axis of the user, and/or the longitudinal axis in the third section is perpendicular or perpendicular+/−10% to the ear-to-ear axis of the user. For example, the shield unit may obtain a U-shaped geometry or curved, wherein the shield unit may be arranged within the housing such that the opening of the shield unit is configured to guide the electromagnetic near field energy into a direction being either perpendicular (or perpendicular+/−10%) or parallel (or parallel+/−10%) to the ear-to-ear axis and away from an absorptive medium, e.g. a head of the user wearing the hearing device behind its ear.

A transversal axis in the first section may be perpendicular or perpendicular within +/−10 deg. to the ear-to-ear axis of the user, a transversal axis in the second section is parallel or parallel+/−10 deg. to the ear-to-ear axis of the user, and/or the transversal axis in the third section is perpendicular or perpendicular+/−10% to the ear-to-ear axis of the user. For example, the shield unit may obtain a U-shaped geometry or curved, wherein the shield unit may be arranged within the housing such that the opening of the shield unit is configured to guide the electromagnetic near field energy into a direction being either perpendicular (perpendicular+/−10%) or parallel (parallel+/−10%) to the ear-to-ear axis and away from the absorptive medium, e.g. a head of the user wearing the hearing device behind its ear.

A longitudinal length of the shield unit along the longitudinal axis may be between 5 mm and 28 mm, and a transverse length of the shield unit, perpendicular (or perpendicular+/−10%) to the longitudinal axis, may be between 4 mm and 28 mm, 4 mm and 7 mm or 6 mm and 20 mm.

A longitudinal length of the second section along the ear-to-ear axis of the user may be between 1 mm and 7.45 mm or below 1/16 wavelength at the operational frequency.

The ground unit may comprise a printed circuit board and/or a battery.

The hearing device may be a behind-The-Ear hearing device or a Receiver-In-The-Ear hearing device. Additionally, the shield unit may be included into other designs of a hearing device.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIGS. 6A-6D, illustrates a hearing device, where the antenna unit has one or more active units.

DETAILED DESCRIPTION

Figure 1A:
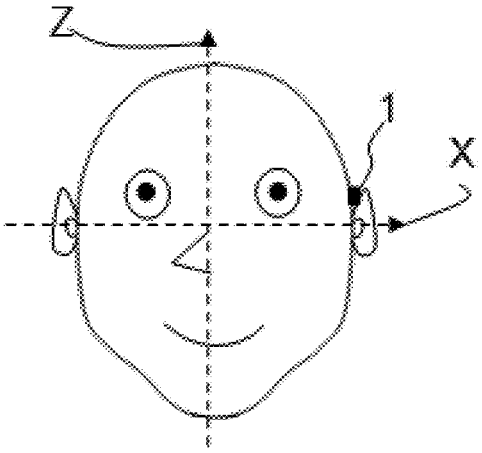
FIGS. 1A-1B, illustrates a front view and a top view of a user wearing a hearing device in its operational position.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals or with a receiver/loudspeaker arranged close to or in the ear canal such as in a Behind-the-Ear type hearing aid or a Receiver-in-the Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

A "hearing system" refers to a system comprising one or two hearing devices, disclosed in present description, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Figure 1B:
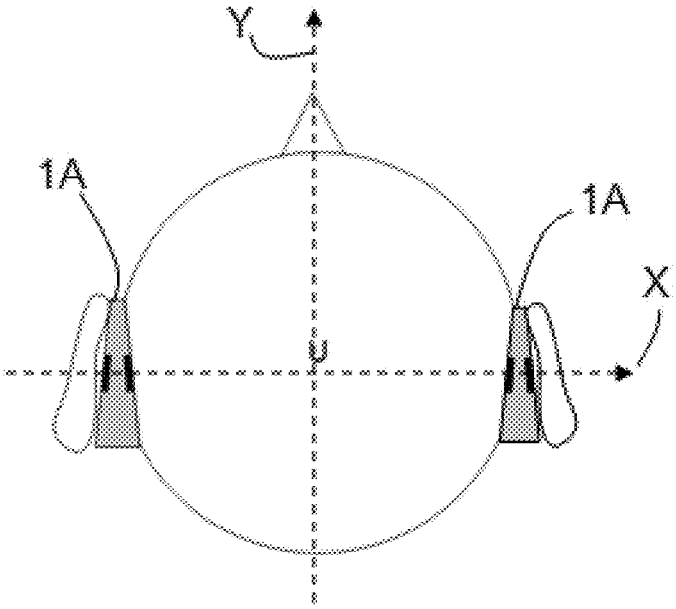

FIGS. 1A-1B illustrates a front view and a top view of a user wearing a hearing device (1, 1A) in its operational position, which in this particular example is behind the ear of the user.

FIG. 1A illustrates an ear-to-ear axis 'X' extending from left ear to right ear of the user wearing the hearing device 1. Furthermore, an upper-to-lower axis 'Z' extends from lower to upper part of the head of the user.

FIG. 1B illustrates the hearing device 1 as part of a binaural hearing device system where a second hearing device 1A is positioned at the opposite ear of the ear wearing the hearing device 1. Furthermore, an end-to-end axis 'Y' extends from the back part to the front part of the head of the user. The centre of the head of the user is denoted 'U' on FIG. 1B.

Figure 2A:
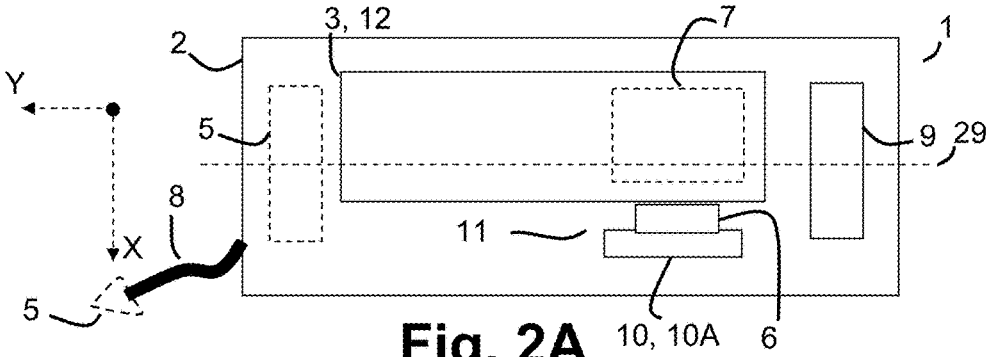
FIGS. 2A-2B, illustrates an example of a behind-the-ear hearing device and an example of a receiver-in-the-ear hearing device.
Figure 2B:
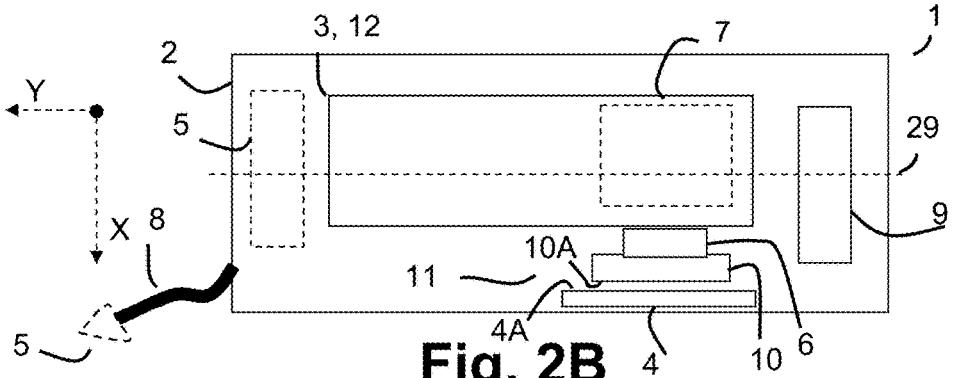

FIGS. 2A-2B illustrates examples of hearing devices 1, where FIG. 2A illustrates a Behind-The-Ear hearing device (BTE) 1 where a receiver 5 is either positioned within a housing 2 or at the end of a tube 8. If the receiver 5 is positioned at the end of the tube 8, the tube 8 comprises two wires to transmit an electrical audio signal. In another embodiment where the receiver 5 is positioned within the housing 2, the tube 8 is configured to guide an audio wave signal from the receiver 5 and into an ear of a user wearing the hearing device 1.

In this particular example, the hearing device 1 comprises an antenna unit 11 which includes an active unit 10 (with an active surface 10A) connected to a feeder unit 6. The feeder unit 6 supplies the active unit 10 with a current so that the active unit 10 may generate an electric field. Additionally, the hearing device 1 comprises a microphone 9, a battery, and a printed circuit board (PCB) 3.

In this particular example, the ground plane of the antenna unit is the PCB 3. In a different example, the ground plane 12 may be, at least partly, the battery 7, further, the ground plane may be constituted by a combination of components.

FIG. 2B illustrates a hearing device 1 similar to the one illustrated in FIG. 2A, but in this particular example, the antenna unit 11 further comprises a shield unit 4 positioned adjacent to the active unit 10 of the antenna unit 11. The shield unit has a continuous surface 4A positioned adjacent to the active surface 10A.

The distance between the continuous surface of the first section of the shield unit 4 and the active surface is between 0.1 mm and 1.5 mm, 0.1 mm and 3.5 mm, 0.5 mm and 5 mm, 0.1 mm and 10 mm.

The direction of the electric field transferred by the capacitive coupling between the active surface 10A and the continuous surface 4A is parallel to the ear-to-ear axis (X-axis), when the hearing device 1 is worn by the user at one ear.

Figure 3A:
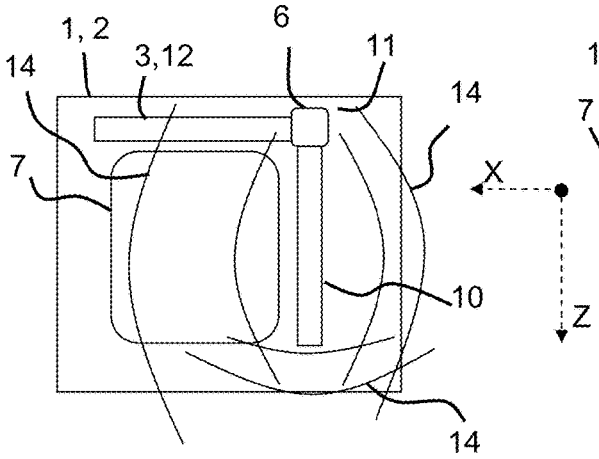
FIGS. 3A-3B, illustrates a hearing device with and without a shield unit.
Figure 3B:
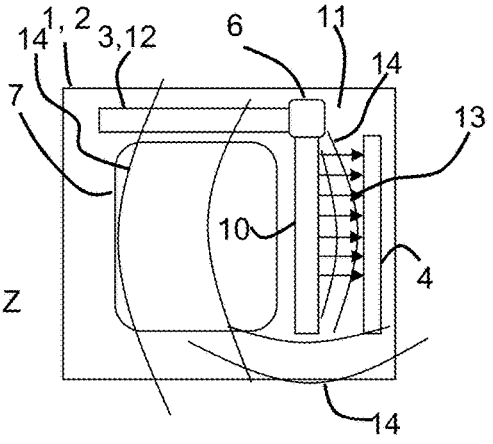

FIGS. 3A and 3B illustrates a hearing device 1 respectively without and with the shield unit 4, respectively. In FIG. 3A, the antenna unit 11 does not have a shield unit 4 and the generated electromagnetic near field 14 is radiating in all directions. In FIG. 3B, the antenna unit 11 comprises a shield unit 4 limiting the radiation of the electromagnetic near field 14 in the direction of the capacitive coupling 13. In this particular example, the electromagnetic near field 14 is limited in the direction along the ear-to-ear axis (X-axis).

Figure 4A:
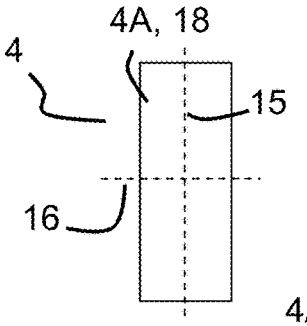
FIGS. 4A-4D, illustrates shield units having different shapes.
Figure 4B:
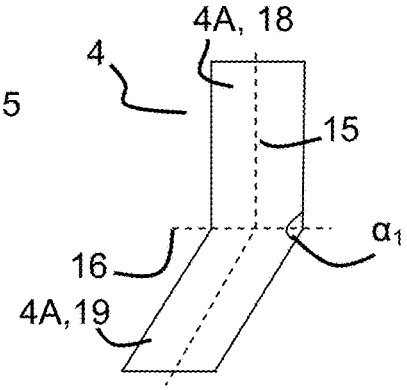
Figure 4C:
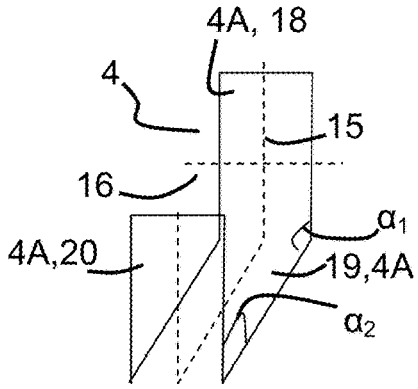
Figure 4D:
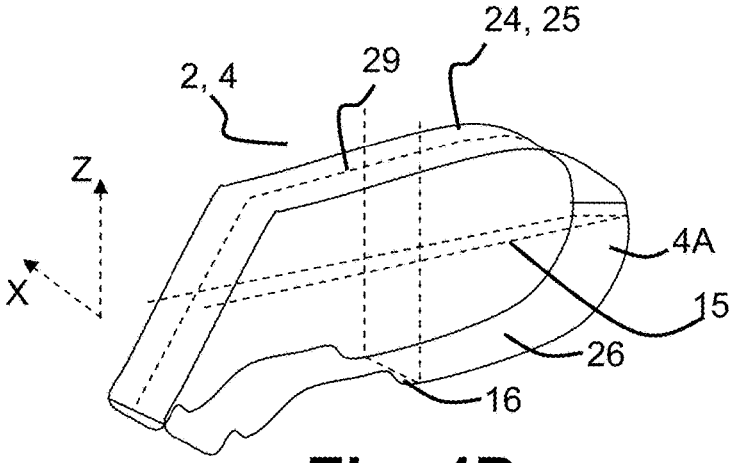

FIGS. 4A-4D illustrates, schematically, various shapes or types of the shield unit 4. FIG. 4A illustrates a shield unit 4 with a continuous surface 4A having a first section 18, and where the continuous surface 4A has a longitudinal direction 15 and a transversal direction 16, along the long and short side respectively. In FIG. 4B, the first section 18 is extended with a second section 19, thereby establishing two sections of the continuous surface 4A. The first section 18 and the second section 19 are arranged with a first angle $\alpha_1$, where the first angle may be between 20 deg. and 179 deg. or between 5 deg. and 90 deg. In FIG. 4C, the continuous surface 4A is further extended with a third section 20, and where the second 19 and third section 20 are arranged with a second angle. The second angle $\alpha_2$ may be between 20 deg. and 179 deg. or between 5 deg. and 90 deg. In FIG. 4D, the continuous surface 4A of the shield unit 4 comprises multiple sections being part of a housing 2 of a hearing device 1. In this particular example, the housing 2 may have at least one emitting section 24, i.e. a section which is not continuously part of the housing. The emitting section 24 may be made of a material different from the remaining sections or surfaces of the housing 2. This section 24 may be denoted as an emitting surface. The material may have the characteristic of being able to transfer electromagnetic near field energy, generated by the antenna unit, towards the surrounding of the hearing device 1. The remaining sections or surfaces, i.e. the shielding part of the housing 2, are able to reflect the electromagnetic near field in order to reduce the amount of electromagnetic near field energy radiating in unwanted directions, e.g. into a head of a user of the hearing device 1.

In the particular example, shown in FIG. 4D, the emitting section 24 is position on the top surface 25 of the hearing device. In another embodiment, the emitting section 24 may be positioned on the bottom surface 26 of the hearing device. When the housing 2 is worn in its operational position by the use, an axis going from the top surface 25 to the bottom surface 26 is perpendicular or almost perpendicular to the ear-to-ear axis.

FIGS. 5A-5D schematically illustrates different configuration of the antenna unit 11 comprising a substrate 17 where the active unit 10 and the shield unit 4 are attached on opposite surfaces of the substrate 17.

Figure 5A:
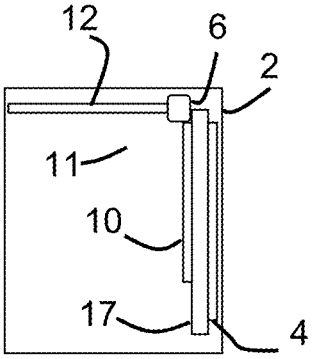
FIGS. 5A-5D, illustrates shield units having different shapes with and without a flex PCB substrate.
Figure 5B:
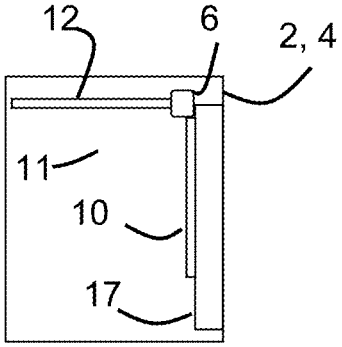
Figure 5C:
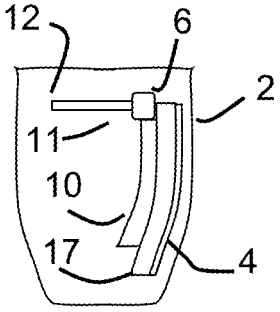
Figure 5D:
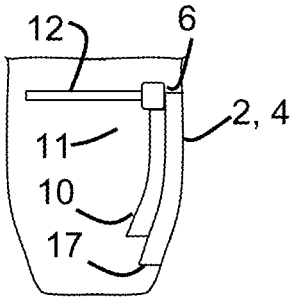

In FIG. 5A the active unit 10 and the shield unit 4 are attached on opposite parallel surfaces of the substrate 17, and the active unit 10 is coupled to the ground unit 12 via the feeder unit 6. In FIG. 5B, the shield unit 4 is the housing 2. The active unit 10 is attached to a first substrate surface of the substrate 17 and on the opposite parallel surface, i.e. a second substrate surface, the housing 2 is attached. In FIGS. 5C and 5D the shape of the housing 2 is curved, and the shape of the substrate 17 is adapted to the shape of the housing 2. In these particular examples, the substrate 17 is a flexible print circuit board. In both examples, same capacitive coupling distance is achieved between the active surface 10A of the active unit 10 and the continuous surface 4A of the shield unit 4, and thereby, it is possible to obtain a stable capacitive coupling efficiency independent of the shape of the housing. Thereby, the production stability and reproducibility of the antenna unit 11 and the hearing device 1 comprising the antenna unit 11, is improved.

FIGS. 6A-6D schematically illustrates various configurations of the antenna unit 11 within the housing 2 of the hearing device 1. In FIG. 6A, the antenna unit 11 comprises a ground unit 12, a feeder unit 6, an active unit 10 and a shield unit 4. (In FIG. 6D, the ground unit is not shown). In FIG. 6A, the shield unit 4 has a continuous surface 4A including a first section 18 and a second section 19, where the first section 18 is located adjacently or close to the active surface 10A of the active unit 10. It is seen that the first section 18 and the second section 19 forces the electromagnetic near field 14, generated by the capacitive coupling 13, to radiate generally in one direction along the ear-to-ear axis (X-axis) and in one direction along the lower-to-upper axis (Y axis), or limits the energy of the electromagnetic near field 14 going out of the hearing aid in these directions. In other directions, the energy of the electromagnetic near field 14 becomes lower, and thereby, the radiation efficiency of the antenna unit improves.

The distance or capacitive coupling distance between the active surface 10A and the continuous surface 4A may be within a range of 30 μm to 3 mm, 0.05 mm to 2 mm, 0.1 mm to 5 mm, 0.15 mm to 10 mm or 1 mm to 2 mm.

Additionally, in this particular example, shown in FIG. 6A, the radiation efficiency of the antenna unit becomes higher when the hearing device 1 is worn on the ear of the user such that the active unit 10 is positioned closer to the center of the head U of the user than the shield unit 4.

Furthermore, in this particular example, the radiation efficiency of the antenna unit becomes significantly higher when the hearing device 1 is worn on the ear of the user such that the continuous surface 4A is positioned closer to the center U of the head of the user than the active surface 10A. That is because the shield unit comprising the first and the second section is focusing the radiation of the electromagnetic near field in a direction away from the users head, and thereby obtaining a higher radiation efficiency in the direction away from the users head.

In FIG. 6B, the continuous surface 4A of the shield unit 4 has a first section 18, a second section 19 and a third section 19, forming a U-shaped shield unit 4 comprising the capacitive coupling 13 between the active surface 10A and the first section of the continuous surface 4A. In this particular example the radiation of the electromagnetic near field 14 has been limited in both directions along the ear-to-ear axis (X) and in one direction along the upper-to-lower axis.

In the antenna unit 11 in FIG. 6B, the radiation efficiency of the antenna unit 11 becomes significantly higher, compared to when the antenna unit has no shield and compared to the example illustrated in FIG. 6A, regardless of whether it is located on the right or the left side of the head of the user. This is caused by the shield unit 4 which in this particular example, shields the electromagnetic near field 14 in both directions along the ear-to-ear axis (X) focusing the electromagnetic near field in the directions along the end-to-end axis (Y axis) and in one direction along the upper-to-lower axis (Z-axis).

FIG. 6C illustrates an antenna unit 11 comprising at least two active units 10 or a single continuous active unit 10 and a shield unit 4 with multiple continuous surfaces, including a first section 18, a second section 19 and a third section 20. The antenna unit 11 generates an electromagnetic near field 14 by multiple capacitive couplings 13.

The hearing device 1 may be configured to be worn at an ear of a user, where the hearing device 1 comprises an antenna unit 11. The antenna unit 11 may comprises multiple active units 10 or a single continuous active unit 10 with multiple active surfaces being connected to a ground unit 12 by a feeder unit 6, each of the active units 10 or the single continuous surface 10 include(s) an active surface 10A, and furthermore, the antenna unit 11 comprises a shield unit 4 having a continuous surface 4A, where a first section 18 and a second section 19 of the continuous surface 4A may be arranged adjacent to the respective active surfaces 10A. Furthermore, the respective active surfaces 10A may be configured to transmit an electric field in a direction along or perpendicular to an ear-to-ear axis of the user when the hearing device 1 may be worn in its operational position by the user, whereby the electric field may then be coupled by capacitive couplings 13 toward the first section 18 and second section 19 thereby generating an electromagnetic near field 14, and where the shield unit 4 may be configured to focus the electromagnetic near field 14 inside the hearing device 1.

The electric field may be transmitted from the active surface 10A of the active unit 10 in a direction perpendicular to the ear-to-ear axis (X-axis) when the hearing device is worn at an ear of the user.

FIGS. 7A-7D are schematic illustrations of simulated electric near fields 14A (being part of the electromagnetic near field 14) generated by the antenna unit 11 of the hearing device 1 positioned on a left or a right ear of a user. The antenna unit 11 may be with or without a U-shaped shield unit 4. The U-shaped shield unit 4 is open in both directions along the Y-axis and open in one direction along the Z-axis, i.e. the shield unit 4 is open in the direction from the lower part of the head of the user to the upper part of the head of the user. The active unit 10 of the antenna unit 11 is positioned on the left side of the housing 2.

The simulated electric near field 14A is illustrated by the contour lines, where an increase of the concentration of the contour lines corresponds to an increase of the strength of the electric near field 14A.

Figure 7A:
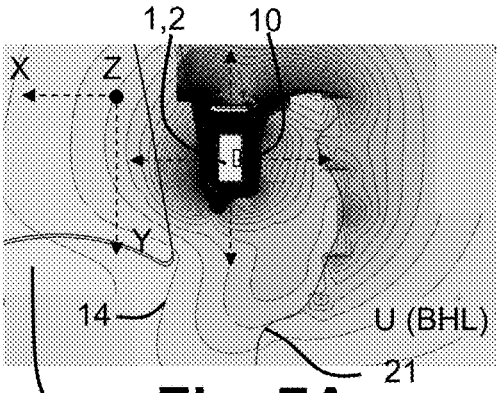
FIGS. 7A-7D, illustrates simulated radiation pattern of a hearing device with and without a shield unit.
Figure 7B:
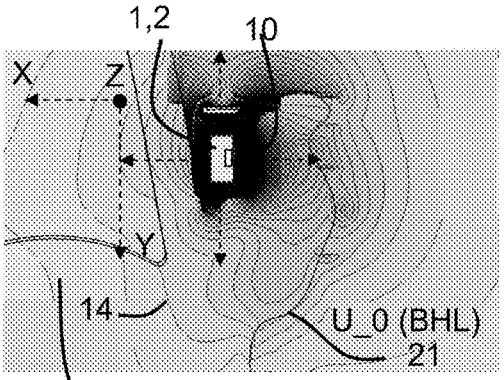

FIGS. 7A and 7B illustrates simulated electric near field 14A generated by the antenna unit, at an operational frequency of 2.4 GHz, with (U_BHL) and without (U_0_BHL) the U-shaped shield unit 4, respectively, and where the hearing device 1 is positioned at the left ear 21 of the user. Comparing the shape of the electric near field 14A in FIG. 7A with the electric near field 14A in FIG. 7B, it is seen that the shield unit 4 reduces the radiation in the direction towards the left ear 21 of the user and along the ear-to-ear axis. Whereas the strength of the electric near field 14A has increased along the Y-axis, i.e. between the back part and the front part of the head 23 of the user, and slightly in the ear-to-ear axis towards the head 23, i.e. along the X-axis. The electric near field 14A is also increased in the Z-axis in the direction from the lower part to the upper part of the head 23.

Figure 7C:
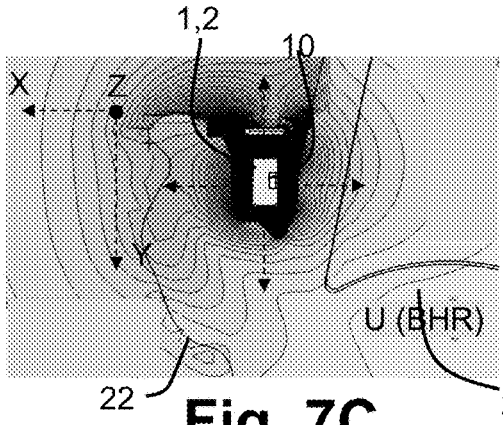
Figure 7D:
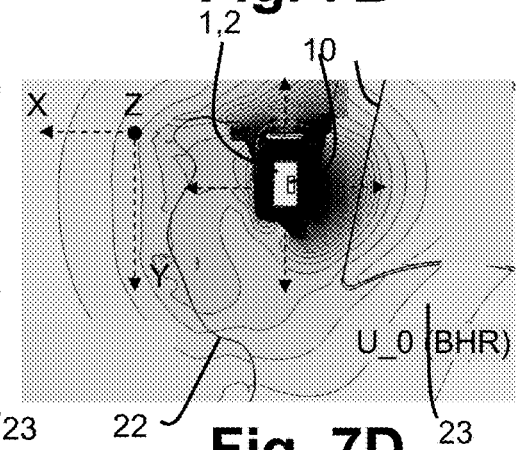

FIGS. 7C and 7D illustrates simulated electric near field 14A generated by the antenna unit 11 with (U_BHR) and without (U_0_BHR) the U-shaped shield unit 4, respectively, and where the hearing device 1 is positioned on the right ear 22 of the user. Comparing the electric near field 14A in FIG. 7C and the electric near field 14A in FIG. 7D, it is seen that the shield unit 4 reduces the strength of the electric near field 14A in the direction towards the head 23 of the user and along the ear-to-ear axis. Instead, the electric near field 14A has increased along the Y-axis, i.e. between the back part to the front part of the head 23 of the user, and slightly in the ear-to-ear axis (X) towards the right ear 22 of the user. The radiation 14 is also increased in the Z-axis in the direction from the lower part to the upper part of the head 23.

Figure 8:
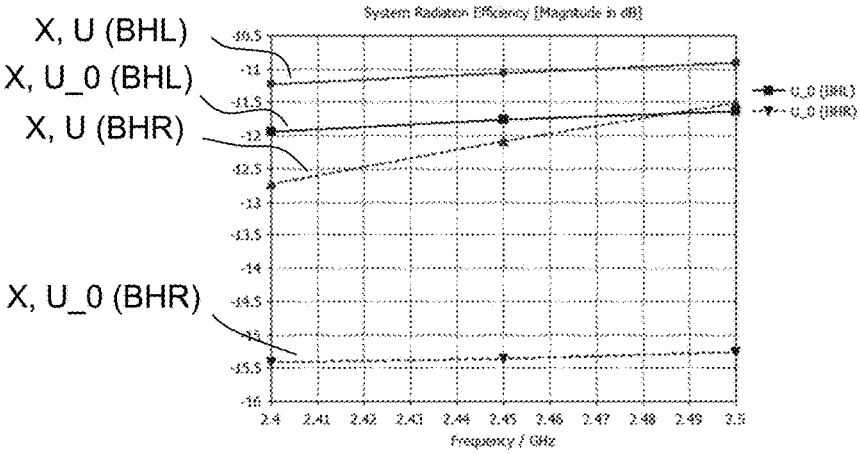
FIG. 8 illustrates simulated radiation efficiency curve of the simulated radiation pattern of the hearing device with and without a shield unit.

FIG. 8 illustrates the radiation efficiency of the electric near field 14A as a function of frequency, for each of the situations described in relation to FIGS. 7A to 7D, where the hearing device 1 with the U-shaped shield unit 4 positioned on the left ear 21 is denoted by U_BHL, the hearing device 1 without the U-shaped shield unit 4 positioned on the left ear 21 is denoted by U_0_BHL, the hearing device 1 with the U-shaped shield unit 4 positioned on the right ear 22 is denoted by U_BHR, and the hearing device 1 without the U-shaped shield unit 4 positioned on the right ear 22 is denoted by U_0_BHR.

The situation where the hearing device 1 is positioned on the left ear 21, it is seen that the shield unit 4 increases the radiation efficiency, at the operation frequency of 2.45 GHz, with approximately 0.75 dB, when comparing the simulated results of the hearing device with and without the shield unit 4 and positioned on the left ear 21. In the situation where the hearing device 1 is positioned on the right ear 22, it is seen that the shield unit 4 has an improved impact on the radiation efficiency. With the shield unit 4 it is seen that the radiation efficiency increases with more than 3 dB.

A larger radiation efficiency difference between U_BHR and U_0_BHR is seen, i.e. when the hearing device 1 is positioned on the right ear 22, because the radiation of the electric near field 14A, generated by the active unit 10, and the capacitive coupling 13 is directed towards the head 23 of the user and not the ear (21, 22). As the head 23 comprises more tissue than an ear, the head 23 is more absorptive than the ear (21, 22).

Furthermore, it is seen that the radiation efficiency difference between U_BHL and U_BHR is approximately 1 dB, and the radiation efficiency difference between U_0_BHL and U_0_BHR is approximately 3.5 dB. Thereby, the left/right performance stability is improved with approximately 2.5 dB when the antenna unit includes the U-shaped shield unit.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

| | |
|---|---|
| 1 | Hearing device |
| 1A | Hearing device in a binaural hearing aid system, |
| 2 | Housing |
| 3 | Printed Circuit Board (PCB) |
| 4 | Shield unit |
| 4A | Continuous surface |
| 5 | Receiver |
| 6 | Feeder unit |
| 7 | Battery |
| 8 | Tube |
| 9 | Microphone |
| 10 | active unit |
| 10A | Active surface |
| 11 | Antenna |
| 12 | Ground unit |
| 13 | Capacitive coupling |
| 14 | Electromagnetic near field |
| 14A | Electric near field |
| 15 | Longitudinal direction |
| 16 | Transversal direction |
| 17 | Substrate |
| 18 | First section |
| 19 | Second section |
| 20 | Third section |
| 21 | Left ear of a user |
| 22 | Right ear of a user |
| 23 | Head of a user |
| 24 | Emitting section |
| 25 | Top surface of housing |
| 26 | Lower surface of housing |
| 27 | First plane |
| 28 | Second plane |
| 29 | Centre of housing |
| X | Ear-to-ear axis |
| Y | End-to-end axis extending from the back part to the front part of the head of the user |
| Z | Upper-to-lower axis extending from lower to upper part of the head of the user |
| U | Center of the head |
| $\alpha_1$ | First angle |
| $\alpha_2$ | Second angle |

The invention claimed is:

1. A hearing device comprising:

a housing configured to be worn at an ear of a user;

a ground unit, an antenna unit, a feeder unit for feeding a current to the antenna unit, and wherein the antenna unit comprises:

an active unit being connected to the ground unit by the feeder unit, the active unit includes an active surface, a shield unit having a continuous surface, where a first section of the continuous surface is arranged adjacent to the active surface, and wherein the active surface is configured to transmit an electric field in a direction along or perpendicular to an ear-to-ear axis of the user when the hearing device is worn in its operational position by the user, wherein the active unit is attached or coated on a first substrate surface of a substrate, and the shield unit is attached or coated on a second substrate surface of the substrate, whereby the electric field is coupled by a capacitive coupling towards the first section generating an electromagnetic near field, and where the shield unit is configured to shape the electromagnetic near field, and wherein the substrate is attached or mounted on the housing via the second substrate surface of the substrate.

2. A hearing device according to claim 1, wherein the shield unit comprises a second section arranged with the first section with a first inner angle in an inner space, and wherein the first inner angle is between 25 deg. and 160 deg, and where the inner space formed between the first section and the second section provides the capacitive coupling.

3. A hearing device according to claim 2, wherein the continuous surface is extending along a longitudinal axis forming a third section in the extension of the second section, where the inner space is between the first section, the second section and the third section.

4. A hearing device according to claim 3, wherein the second section and the third section are arranged with a second inner angle in the inner space, and wherein the second inner angle is between 25 deg. and 160 deg.

5. A hearing device according to claim 1, wherein a first plane of the active surface and a second plane of the first section are parallel or parallel within +/−10 degrees.

6. A hearing device according to claim 2, wherein the hearing device comprises a housing including an element, such as a battery or a receiver, positioned in the inner space.

7. A hearing device according to claim 1, wherein the active unit is positioned closer to a centre of the housing than the shield unit, and wherein the centre is positioned at the half width of the housing along the ear-to-ear axis.

8. A hearing device according to claim 1, wherein the antenna unit is adapted to have an operational frequency in the range from 300 MHz to 6 GHz, 500 MHz to 1 GHz, around 865 MHz or around 2.441 GHz.

9. A hearing device according to claim 7, wherein the shield unit is the housing, and wherein the housing comprises at least one non-metallic surface.

10. A hearing device according to claim 1, wherein the material of the shield unit is a metal, such as aluminum, copper, or any conductive metal.

11. A hearing device according to claim 3, wherein the longitudinal axis in the first section is perpendicular to the ear-to-ear axis of the user, the longitudinal axis in the second section is parallel to the ear-to-ear axis of the user, and/or the longitudinal axis in the third section is perpendicular to the ear-to-ear axis of the user.

12. A hearing device according to claim 3, wherein a longitudinal length of the shield unit along the longitudinal axis is between 5 mm and 28 mm, and a transverse length of the shield unit perpendicular to the longitudinal axis is between one of 4 mm and 28 mm, 4 mm and 7 mm, and or 6 mm and 20 mm.

13. A hearing device according to claim 2, wherein a longitudinal length of the second section along the ear-to-ear axis of the user is between 1 mm and 7.45 mm or below 1/16 wavelength at the operational frequency.

14. A hearing device according to claim 1, wherein the ground unit comprises a printed circuit board and/or a battery.

15. A hearing device according to claim 1, wherein the hearing device is a behind-The-Ear hearing device or a Receiver-In-The-Ear hearing device.

16. A hearing device according to claim 1, wherein the substrate is a flexible printed circuit board substrate, such as a flexible material where the electric field, generated by the active unit, is coupled through the substrate and towards the shield unit attached or coated to the second substrate surface.

17. A hearing device according to claim 1, wherein the first substrate surface and the second substrate surface is parallel or parallel+1-10%.

18. A hearing device configured to be worn at an ear of a user, where the hearing device comprising;

a ground unit, an antenna unit, a feeder unit for feeding a current to the antenna unit, and wherein the antenna unit comprises:

an active unit being connected to the ground unit by the feeder unit, the active unit includes an active surface, a shield unit having a continuous surface, where a first section of the continuous surface is arranged adjacent to the active surface, and wherein the active surface is configured to transmit an electric field in a direction along or perpendicular to an ear-to-ear axis of the user when the hearing device is worn in its operational position by the user, whereby the electric field is coupled by a capacitive coupling towards the first section generating an electromagnetic near field, and where the shield unit is configured to shape the electromagnetic near field, wherein the shield unit comprises a second section arranged with the first section with a first inner angle in an inner space, and wherein the first inner angle is between 25 degrees and 160 degrees and where the inner space formed between the first section and the second section provides the capacitive coupling.

19. A hearing device configured to be worn at an ear of a user, where the hearing device comprising;

a ground unit, an antenna unit, a feeder unit for feeding a current to the antenna unit, and wherein the antenna unit comprises:

an active unit being connected to the ground unit by the feeder unit, the active unit includes an active surface, a shield unit having a continuous surface, where a first section of the continuous surface is arranged adjacent to the active surface, and wherein the active surface is configured to transmit an electric field in a direction along or perpendicular to an ear-to-ear axis of the user when the hearing device is worn in its operational position by the user, whereby the electric field is coupled by a capacitive coupling towards the first section generating an electromagnetic near field, and where the shield unit is configured to shape the electromagnetic near field, wherein the hearing device comprises a housing, and wherein the active unit is positioned closer to a centre of the housing than the shield unit, and wherein the centre is positioned at the half width of the housing along the ear-to-ear axis.

* * * * *